US006737582B2

(12) United States Patent
Van Lieu et al.

(10) Patent No.: US 6,737,582 B2
(45) Date of Patent: May 18, 2004

(54) POWER CONNECTOR

(75) Inventors: James R. Van Lieu, Aloha, OR (US); Kory Q. Nguyen, Hazelwood, MO (US)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/325,036

(22) Filed: Dec. 20, 2002

(65) Prior Publication Data

US 2004/0020677 A1 Feb. 5, 2004

Related U.S. Application Data

(60) Provisional application No. 60/400,604, filed on Aug. 2, 2002.

(51) Int. Cl.[7] ..... H01H 13/04

(52) U.S. Cl. ..... 174/53; 174/59; 439/92; 439/97

(58) Field of Search ..... 174/53, 59; 439/92, 439/96, 95, 97, 105, 100

(56) References Cited

U.S. PATENT DOCUMENTS 2,994,849 A * 8/1961 Mossari, Jr. ..... 439/105
3,641,472 A * 2/1972 Phillips, Jr. ..... 439/34
4,113,334 A * 9/1978 Instone ..... 439/96
5,174,768 A * 12/1992 Hewison et al. ..... 439/95
5,185,499 A 2/1993 Yahraus
5,579,201 A 11/1996 Karageozian
5,773,757 A 6/1998 Kenney et al.
5,975,923 A * 11/1999 Chen ..... 439/95
6,081,419 A 6/2000 Pham
6,180,884 B1 1/2001 Tokunaga et al.
6,184,461 B1 2/2001 Flegel
6,335,868 B1 1/2002 Butterbaugh et al.

* cited by examiner

*Primary Examiner*—Dhiru R Patel
(74) *Attorney, Agent, or Firm*—Mark P. Watson

(57) ABSTRACT

A power connector includes a housing having a connecting member mounted thereto, a power input, and a power output. The power input and power output have respective ground leads electrically connected to the connecting member for creating an electrically conductive path from the connecting member to ground. The housing includes a mounting plate for mounting the power connector to the rack. Preferably, the mounting plate has an uninsulated, conductive surface area for making contact with a corresponding uninsulated, conductive surface area on the rack. The power output is formed of a power receptacle adapted to detachably receive the plug of a power cord from one or more of the components. Preferably, the power input is also formed of such a power receptacle, to permit an input power cord to be detached from the power connector.

10 Claims, 3 Drawing Sheets

POWER CONNECTOR

This application claims the benefit of the provisional application Serial No. 60/400,604 filed Aug. 2, 2002, entitled Power Connector, which is incorporated by reference in its entirety.

FIELD OF INVENTION

The present invention relates to a power connector for transferring power to electrical devices in a rack, stand, or cabinet.

BACKGROUND OF THE INVENTION

Computer systems and components are sometimes housed together in a rack or cabinet, or on a stand or support (hereinafter Arack@). Power for the computer system is often provided from a power source such as a wall outlet to the components by a plug strip. In some applications, however, the plug strip is replaced with an uninterruptible power source (AUPS@). An advantage of the UPS is that it prevents the loss or corruption of data due to an unanticipated hard power-down. The UPS or plug strip has a power cord that is fixedly attached thereto. One problem associated with the power cord is that, if the rack is moved beyond the reach of the cord while the cord is plugged into the power source, the cord will be strained and may break if it does not release from the power source.

The rack is sometimes advantageously formed of metal. However, the fact that the metal is conductive to electricity poses a potential safety hazard, if the components or environment should expose the housing to voltage sources.

It is also desirable to reduce electromagnetic interference (AEMI@) produced by the components and to protect the components from electrostatic discharge (AESD@). However, the housing does not typically provide these functions.

Therefore, there is a need for a novel power connector that solves the aforementioned problems and provides the aforementioned features.

SUMMARY OF THE INVENTION

Within the scope of the invention, a power connector is disclosed for use with a rack for supporting one or more computer system components. The disclosed power connector includes a housing having a connecting member mounted thereto, a power input, and a power output. The power input and power output have respective ground leads electrically connected to the connecting member for creating an electrically conductive path from the connecting member to ground. The housing includes a mounting plate for mounting the power connector to the rack. Preferably, the mounting plate has an uninsulated, conductive surface area for making contact with a corresponding uninsulated, conductive surface area on the rack.

The power output is formed of a power receptacle adapted to detachably receive the plug of a power cord from one or more of the components. Preferably, the power input is also formed of such a power receptacle, to permit an input power cord to be detached from the power connector.

DETAILED DESCRIPTION OF THE PREFERRED EMBODIMENT

Figure 1:
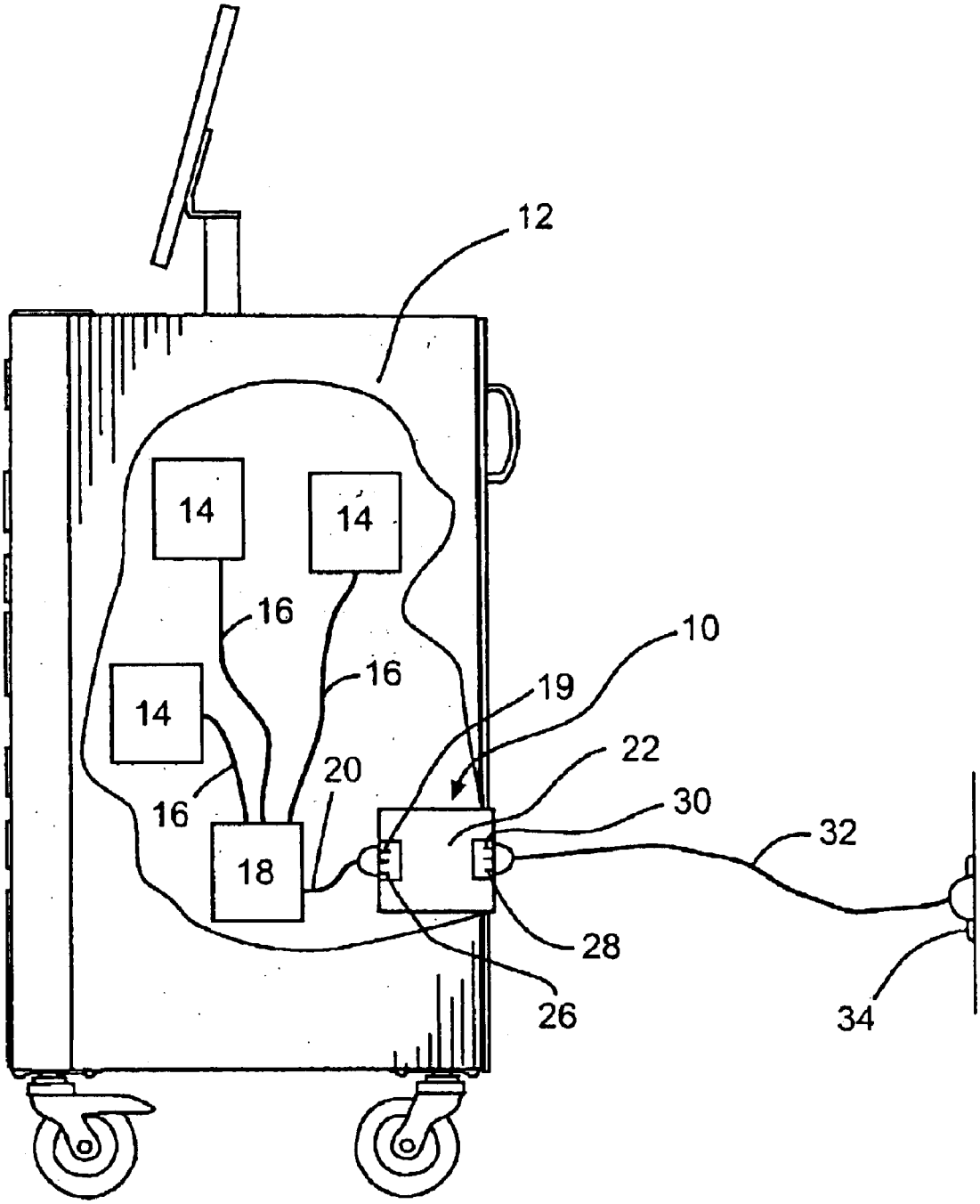
FIG. 1 is a side view of a power connector according to the present invention attached to a metal rack.

A power connector 10 according to the present invention is shown in FIG. 1. The power connector 10 is particularly advantageous for mounting to a rack 12, which holds various components 14 of a computer system. However, the power connector 10 may be used for any purpose for which it is suited without departing from the principles of the invention.

The components 14 are connected through power cord 16 to a power source 18 in the rack 12, such as a UPS, which is in turn connected through a power cord 20 to the power connector 10.

The power connector 10 includes a housing 22 having a power output 26 for receiving a plug 19 of cord 20 to form an electrical connection to the power source 18, and a power input 28 for connecting to an external power source, such as a wall outlet 34. The power output 26 is formed of a power receptacle adapted to detachably receive the plug of a power cord from one or more of the components 14. This also permits a standard power supply, such as the UPS, to be plugged into the power connector 10. Preferably, the power input 28 is also formed of such a power receptacle for receiving a plug 30 of a power cord 32 that is adapted to be plugged into a wall outlet 34. It is often desirable to provide that the rack 12 is on wheels. In that case, the rack 12 may be moved when the power cord 32 is plugged into the wall outlet and power connector 10. It is possible to inadvertently move the rack 12 so far that the reach of the power cord 32 is exceeded, thereby straining the power cord 32. Providing that the power input 28 is formed of a receptacle permitting the power cord 32 to detach therefrom reduces or eliminates the possibility of breaking the power cord 32.

Figure 2:
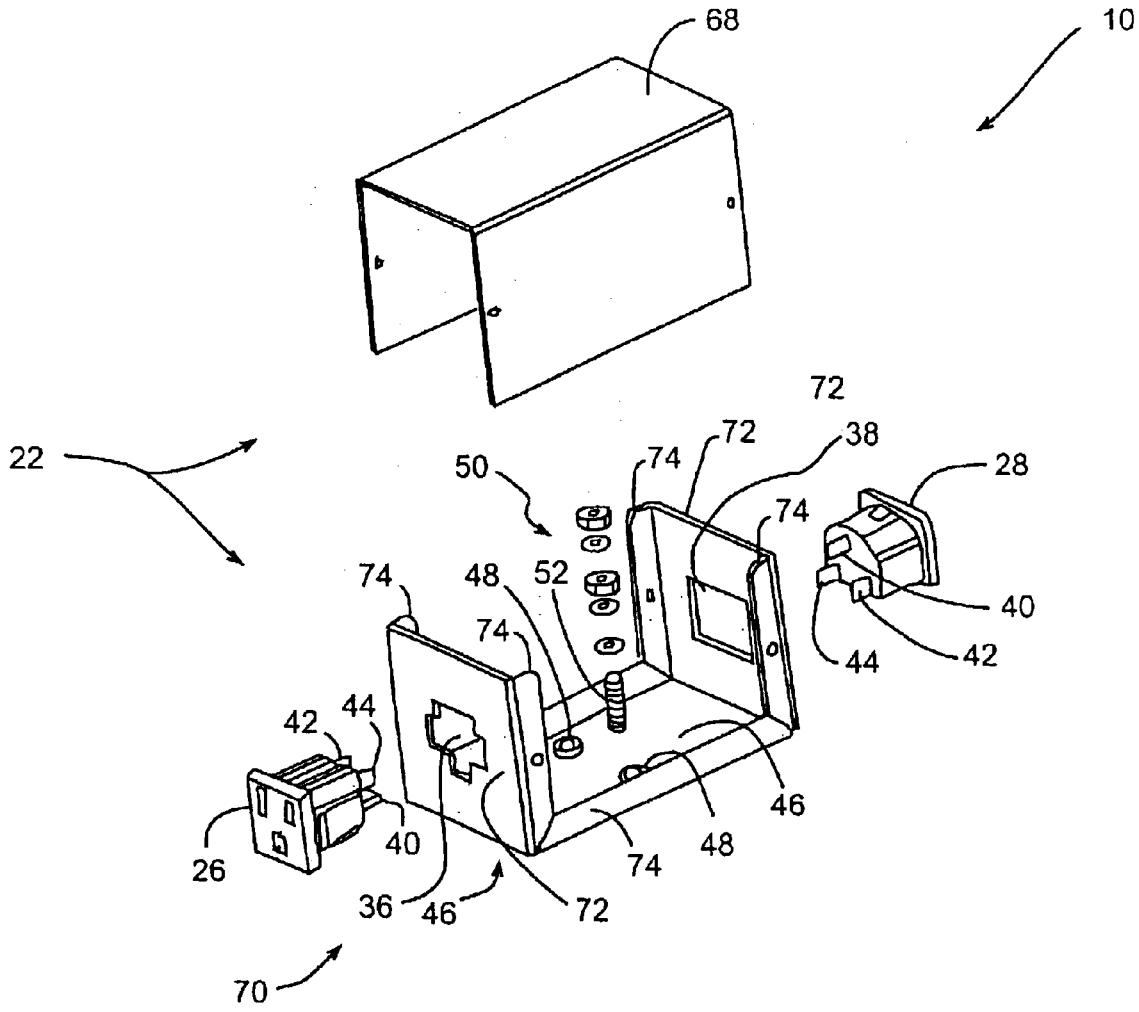
FIG. 2 is an exploded view of the power connector of FIG. 1.

The power output 26 and the input 28 are shown in FIG. 2 as being three-wire power receptacles, which fit into housing apertures 36 and 38 respectively. The receptacles are standard parts for use with standard grounded power cords. In the illustration, the receptacle 26 is female and receptacle 28 is male, but they can be both male or female, or their positions can be changed without departing from the principles of the invention.

According to another aspect of the invention, the housing 22 of the power connector 10 includes a mounting plate 46, that is preferably made of uninsulated, e.g., unpainted, metal for mounting to a corresponding uninsulated portion of the rack. The plate is preferably flat to provide an area of contact with the rack that is substantial, to provide for an electrical connection between the housing of the power connector and the rack that can carry an amount of current that exceeds that required to ensure a desired degree of safety to users of the components in the rack.

Figure 4:
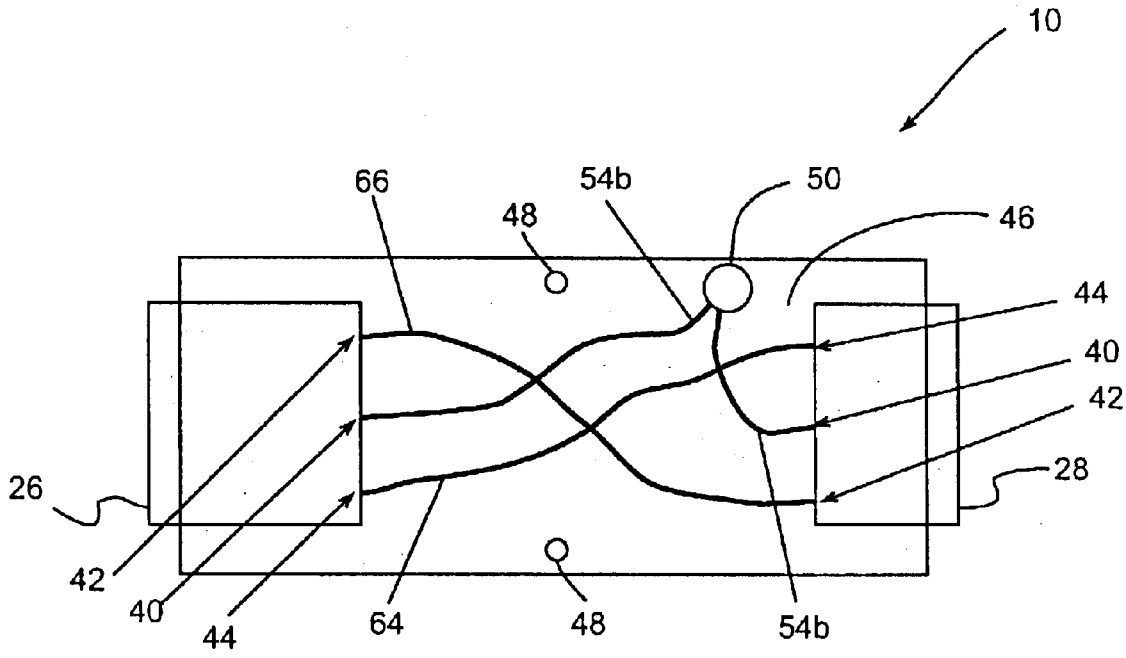
FIG. 4 is a side view of the connector member of FIG. 1.
Figure 3:
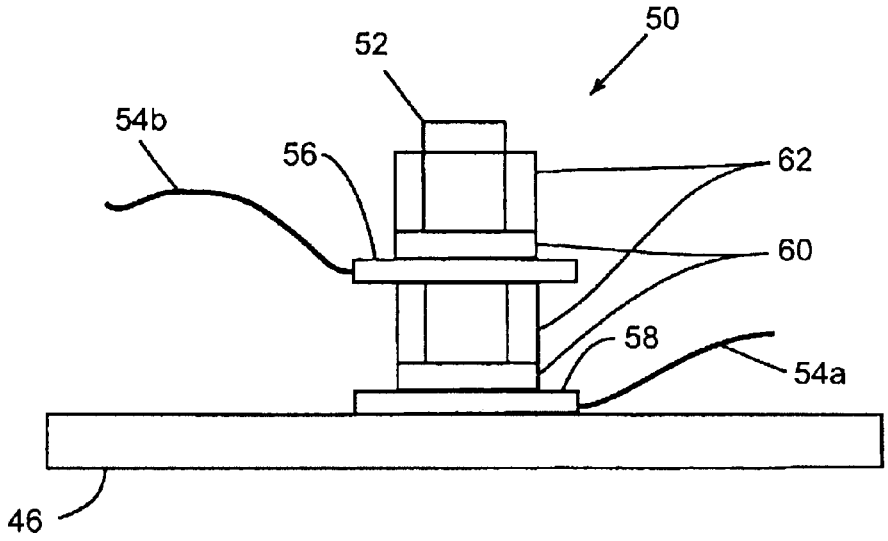
FIG. 3 is a top view of the power connector of FIG. 1 showing leads.

The mounting plate 46 is shown in FIG. 2 as having threaded apertures 48 for threaded attachment by screws to the rack, but other attachment methods can be used without departing from the principles of the invention. The power connector 10 also includes an electrically and physically connecting member 50, which is attached to the mounting plate 46. The connecting member 50 in a preferred embodiment includes a threaded metal post 52 having a non-threaded end that is inserted into a hole formed in the mounting plate 46. As shown in FIGS. 3 and 4, the metal post 52 is connected to the output 26 by a lug 56 that is crimped onto a ground lead 54*b*, and the metal post 52 is connected to the input 28 by a lug 58, that is crimped onto the ground lead 54*a*. Washers 60 and nuts 62 separate the lugs, and hold the lugs in place.

The non-threaded end is mounted tightly into the mounting plate to form an electrical connection capable of carrying the aforementioned current. For example, the non-threaded end can be swaged, press-fitted, or welded into the mounting plate, or electrically connected thereto in any suitable manner without departing from the principles of the invention.

While a connecting member 50 having a threaded post and a non-threaded end has been shown and described as preferred, those of ordinary skill will appreciate that there are numerous alternative structures and methods that may be used to provide the same or similar functionality and the particular structure used is not essential to the invention.

In the preferred embodiment, the connecting member 50 makes electrical contact with the mounting plate 46 which, in turn, makes electrical contact with the rack over the relatively large surface area thereof. However, it is possible to employ the end of the connecting member 50 for making electrical contact with the rack directly, such as by providing that it extends beyond the mounting plate.

An outstanding advantage of the power connector 10 is that it provides for grounding the rack. This reduces or eliminates any safety hazard caused by exposure of the rack to voltage sources, such as from the components themselves or from the external environment. It also provides a path for draining EMI captured by the rack, and it provides a path for conducting ESD applied to the rack.

FIG. 4 is a top view of the power connector 10 showing lead connections. The power output 26 and input 28 each have a ground terminal 40, a neutral terminal 42 and a hot terminal 44. The neutral terminal 42 of the power output 26 is electrically connected via a neutral lead 66 to the neutral terminal 42 of the power input 28. The hot terminal 44 of the power output 26 is electrically connected via a hot lead 64 to the hot terminal 44 of the power input 28.

Referring to FIG. 4, the ground terminal 40 of the power input 28 is connected to the ground via ground lead 54*a*, which is attached to the connecting member 50. The connecting member 50 is connected to ground via lead 54*b*, which is attached to the ground terminal 40 of the power output 26. The wall outlet is in turn connected to ground through structures in the building. The ground lead also preferably has a larger diameter than the hot and neutral leads, so that it can carry more current than the input leads, to provide a margin of safety.

Figure 5:
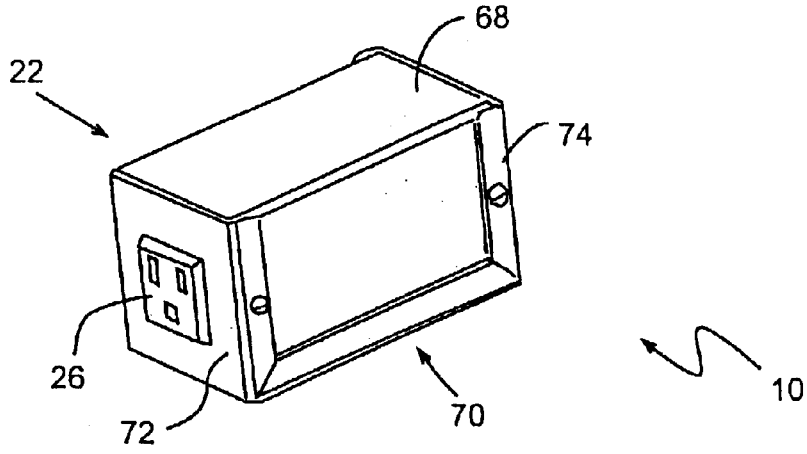
FIG. 5 is a perspective view of the power connector of FIG. 1.

Returning to FIG. 2, the housing 22 preferably includes a cover 68, and a base 70. The base 70 includes the mounting plate 46 and has sidewalls 72 with folded ends 74. As shown in FIG. 5, the cover 68 slides into the base 70 and fits between the sidewalls 72 and the ends 74. However, the base and cover can have different configurations and be attached in other ways, or made of a single piece without departing from the principles of the invention. The cover and base are preferably formed of metal for durability. Since the mounting plate is preferably formed of metal to provide the desired conductivity, it is also most economical to form at least the entire base of metal as well.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A power connector for powering one or more electrical components in a rack comprising:

an electrically conductive housing having an electrically conductive mounting plate for mounting to and making electrical connection with the rack, said housing having an electrically conductive connecting member;

a power input connector for detachably receiving a first power cord from a source of electrical power external to the rack, said first power cord including at least two power leads and one ground lead for connection to earth ground; and at least one power output connector for detachably receiving a second power cord of one of the electrical components, said second power cord including at least two power leads and one ground lead, and interconnecting the at least two power leads and one ground lead of said first and second power cords, said power input and power output connectors each having respective ground wires physically attached to said connecting member for creating an electrically conductive path from said housing to earth ground.

2. The power connector of claim 1, wherein said mounting plate is substantially flat and formed of metal.

3. The power connector of claim 2, wherein said mounting plate includes at least one mounting aperture for receiving a fastener.

4. The power connector of claim 3, wherein said at least one mounting aperture is threaded for receiving a threaded fastener.

5. The power connector of claim 1, farther comprising said power input and said power outlet each having respective hot and neutral leads electrically coupling said power input and said power output, wherein each said respective ground lead is adapted to conduct more current than said hot leads and said neutral leads.

6. A power system for powering one or more electrical components, comprising:

a rack for holding the one or more electrical components;

an electrically conductive housing having an electrically conductive mounting plate for mounting to and making electrical connection with said rack, said housing having an electrically conductive connecting member;

a power input connector far detachably receiving a first power cord from a source of electrical power external to said rack, said first power cord including at least two power leads and one ground lead for connection to earth ground; and at least one power output connector for detachably receiving a second power cord of one of the electrical components, said second power cord including at least two power leads and one ground lead, and interconnecting the at least two power leads and one ground lead of said first and second power cords, said power input and power output connectors each having respective round wires physically attached to said connecting member for creating an electrically conductive path from said housing to earth ground.

7. The system of claim 6, wherein said mounting plate is substantially flat and formed of metal.

8. The system of claim 7, wherein said mounting plate includes at least one mounting aperture for receiving a fastener.

9. The system of claim 8, wherein said at least one mounting aperture is threaded for receiving a threaded fastener.

10. The system of claim 6, wherein said rack includes wheels for rolling the rack on the floor.

* * * * *